United States Patent [19]

Scullin

[11] 3,997,162

[45] Dec. 14, 1976

[54] DART BOARD GAME

[75] Inventor: Francis E. Scullin, Havertown, Pa.

[73] Assignee: Crown Recreation, Inc., Hollis, N.Y.

[22] Filed: Sept. 22, 1975

[21] Appl. No.: 615,349

[52] U.S. Cl. ..... 273/95 R; 273/102 R; 273/106 A; 273/106.5 A

[51] Int. Cl.[2] ..... A63B 65/02

[58] Field of Search ..... 273/95 R, 102 B, 102 R, 273/106 A, 106.5 A; 46/DIG. 1; 403/282, 353, 389

[56] References Cited

UNITED STATES PATENTS

| | | | |
|---|---|---|---|
| 735,415 | 8/1903 | Schrodel | 273/106.5 A |
| 2,556,029 | 6/1951 | Cohan | 273/106 A |
| 2,683,037 | 7/1954 | Ruczynski | 273/106.5 A |
| 3,829,094 | 8/1974 | Goldfarb | 273/106.5 A |
| 3,855,991 | 12/1974 | Imatt | 273/106.5 A |

FOREIGN PATENTS OR APPLICATIONS

| | | | |
|---|---|---|---|
| 788,356 | 1/1958 | United Kingdom | 273/106.5 A |

*Primary Examiner*—Anton O. Oechsle
*Assistant Examiner*—Vance Y. Hum
*Attorney, Agent, or Firm*—Richard M. Rabkin

[57] ABSTRACT

The dart board game includes a dart, a target board having a target face, and cooperating elements for retaining, on the target face, a removably mounted marker on the dart. Such cooperating elements can consist of cooperating "Velcro" strip material. The dart includes a resilient and flexible portion at which the dart body is removably engaged with the marker, so that upon impact of the dart against the target board, the resilient portion of the dart flexes to allow the Velcro strip to engage without disengagement due to bouncing. This flexing motion compresses the resilient portion, which, as it expands, propels the dart body away from the target board to disengage the dart from the marker. In playing one embodiment of the game, in order for the "score" of a marker to count, the player throwing the dart must catch the rebounding dart body after an impact on the target board.

13 Claims, 7 Drawing Figures

FIG. 1
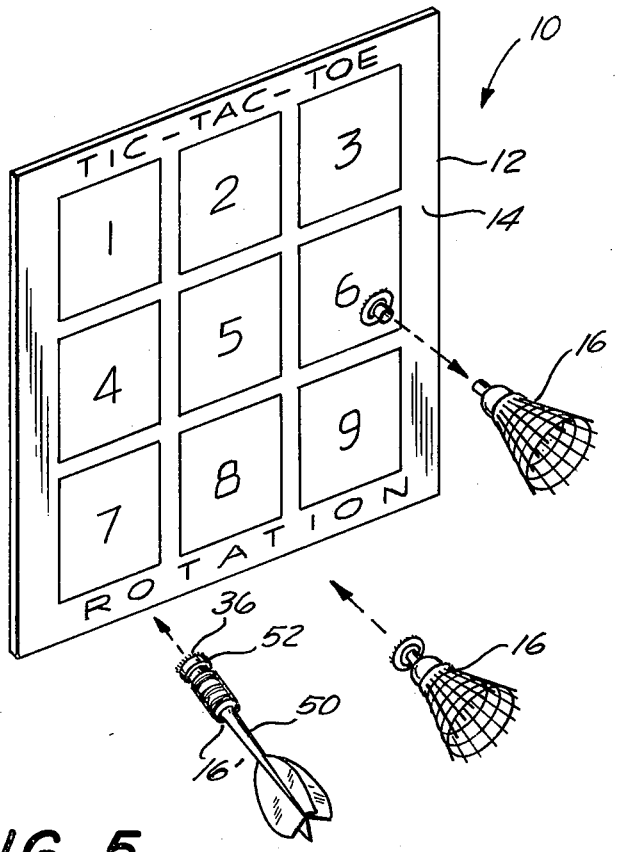
FIG. 2
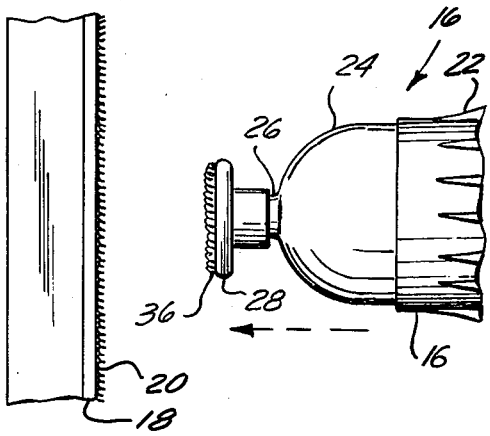
FIG. 3
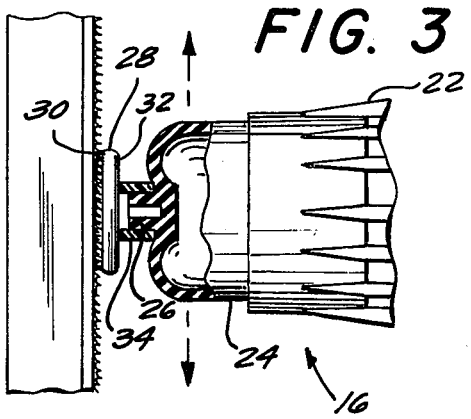
FIG. 5
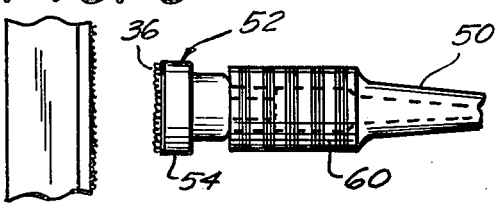
FIG. 6
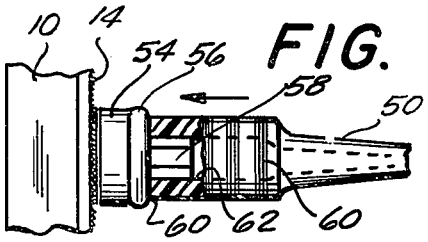
FIG. 7
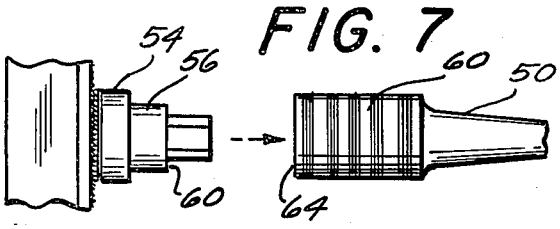
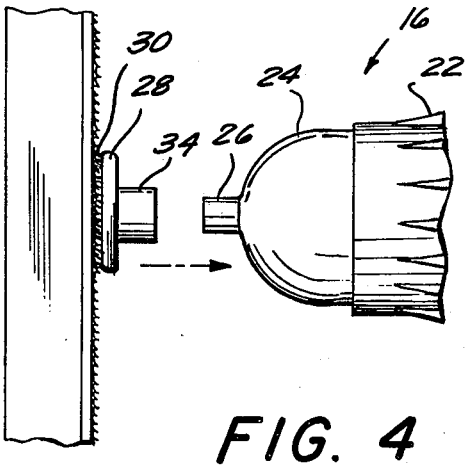
FIG. 4

DART BOARD GAME

The present invention relates to target games, and in particular to a dart board target game.

Various types of dart board games are of course well known, with the most usual type providing darts having sharp points formed of metal. Such conventional games are particularly hazardous to younger children and thus are usually reserved for adult play.

In order to avoid the shortcomings of the conventional metal point type darts for dart games, several alternate types of darts and dart boards have been suggested, as for example are shown in U.S. Pat. Nos. 735,415; 3,032,345; 3,829,094; and 3,857,566. Such dart games use darts having an adhesive means on the impact surface of the dart or cooperating adhesive means and materials on both the target surface and the impact surface of the dart such as are presently available under the commercial name of Velcro. Alternative types of darts utilize magnetic surfaces for the target board and the impact surface of the dart. In such arrangements the adhesive means, Velcro or magnetic, are usually rigidly secured to the dart body so that the entire dart remains on the target after being thrown. However, U.S. Pat. No. 3,829,094 suggests that the adhesive means must be detachable from the dart so that the dart body falls by gravity after impact of the dart with the target board.

In accordance with the present invention a novel and improved target game and dart structure is provided whereby the dart and target board have cooperating means for securing a marker on the dart to the target surface, while the remainder of the dart body is propelled away from the dart board after impact. This is accomplished, in one embodiment of the invention, by forming the impact tip of the dart as a flexible and resilient member which will absorb the momentum of the dart at impact, so as to flex and slightly compress during the impact. This compression, when movement of the dart body has stopped, is automatically released because of the resilient nature of the dart tip and propels the dart body away from the target board. Since the marker member is removably mounted on the tip, the marker remains on the target board while the dart moves therefrom. In the play of one type of game with the present invention, the player throwing the dart must catch the rebounding dart body in order for the score to "count." In addition to this feature of the invention the absorption of the momentum of the dart at impact by flexing of the dart tip, avoids bouncing of the dart on the target board, so that a proper adhesion between the marker and target face can be achieved. As a result there is little tendency for the dart to bounce off of the target board without proper adhesion of the marker and separation of the dart body therefrom. Moreover, the provision of the removable marker permits a relatively larger number of darts to be thrown at the same target without the darts interfering with one another as they are thrown, while the markers remain to leave a visual indication of where the dart struck the target.

The above, and other objects, features and advantages of the invention will be apparent in the following detailed description of an illustrative embodiment thereof, which is to be read in connection with the accompanying drawing, wherein:

FIG. 1 is a perspective view of a target game constructed in accordance with the present invention;

FIG. 2 is an enlarged side view illustrating the approach of a dart towards the target face of the target board;

FIG. 3 is a side view, partly in section, showing the deformation of the dart tip upon impact with the target board;

FIG. 4 is a side elevational view, similar to FIG. 3, showing the disengagement of the dart from the marker element and the propulsion of the dart away from the target board; and FIGS. 5–7 are views similar to FIGS. 2–4 of another embodiment of the present invention.

Referring now to the drawing in detail, and initially to FIG. 1 thereof, it will be seen that a target game 10 constructed in accordance with the present invention includes a target board 12 having a target face 14 towards which one or more projectiles or darts 16, or 16', are manually thrown. The target face 14 is imprinted, in any desired manner, to provide target areas used in the play of various types of dart board games.

In accordance with the presently preferred embodiment of the invention, target board 12 is formed of any type of convenient relatively rigid material, such as for example the composition material presently available under the trade name "Celotex." The target face 14 of board 12 is preferably formed of sheet material 18 such as for example, a textile covering having a surface of a pile fabric which defines a multiplicity of outstanding loops 20 extending therefrom. These loops cooperate with adhesion means on the darts 16, 16' as will be presently described.

The embodiment of the darts used in the present invention which are identified by the reference numeral 16 are somewhat similar to shuttle cocks of the type used in badminton games. Essentially these dart bodies consist of a tail section 22 formed of molded plastic in the general shape of a cone, with a resilient and flexible tip portion 24 secured thereto. The tip preferably is formed from an elastic or rubber material as a hollow and generally semi-shperical element. However the tip also includes a stem 26 that extends outwardly from a central portion of the tip. This stem cooperates with a removable marker member 28 to provide a disengageable connection therebetween.

Marker 28 preferably consists of a molded plastic disc which provides an impact face 30 and a back face 32. An annular collar or sleeve 34 is formed on the back face of the marker and is dimensioned to frictionally receive the stem 26 of the tip 24. The impact face 30 of the marker is provided, in the presently preferred embodiment of the invention, with a sheet of fabric adhered thereto, which sheet has upstanding hooklike filaments formed thereon that are adapted to be engaged and retained by the loops on the target face sheet 18. It will be appreciated that sheet 18 and sheet sections 36 having the hooklike elements formed thereon are similar to the hook and loop textile material combinations sold under the trade name Velcro.

By this construction, when a dart 16 is thrown at the dart board 12 the material 36 on the impact face 30 of the marker element engages sheet 18 so that the hooklike elements of sheet 36 become engaged with loops 20. Because of the resilient and flexible nature of the impact tip 24 of the dart, impact of the dart against the relatively rigid dart board causes the tip 24 to flex, as it absorbs the momentum of the dart. Accordingly the impact tip acts as a cushion which prevents the dart from bouncing against the dart board, and allows the hooklike projections on strip 36 to become properly engaged with loops 20 on sheet 18 to form a firm adhesion therebetween.

When the impact tip 24 has been fully compressed as a result of the force of the throw of the dart, it naturally tends to return to its initial uncompressed configuration. It will be appreciated that this return of impact tip 24 tends to propel the body of the dart outwardly away from the dart board, as shown in FIG. 4. Because of the frictional engagement of stem 26 in the annular sleeve 34, this outward movement of the dart body causes the stem 26 and the collar 34 to become disengaged and the dart body flies away from the dart board. In this connection it is noted that the stem and annular collar are respectively dimensioned such that the frictional adhesion therebetween is less than the adhesion which occurs between the strip 36 and the loops 20 of sheet 18, so that the outward movement of the dart body upon expansion of the compressed impact tip 24, will not cause marker 28 to become disengaged from the dart board, but will allow the impact tip to become disengaged from the marker.

In the course of the play of game with the target board and dart structure of the present invention the players toss the darts at the dart board in accordance with the rules of the particular game being played. Because the dart bodies disengage from the marker and are propelled away from the dart board, only the markers remain to indicate where the dart hit the target area. This allows further darts to be thrown at the dart board without interference from previously thrown darts and their outwardly projecting dart bodies. In addition, because the dart bodies are propelled away from the dart board, as opposed to merely falling from the board directly to the floor under the influence of gravity, an added variation is provided in the game in that the players must catch the dart bodies as they are propelled away from the dart board after an impact in order for their scores to count. Accordingly, an additional degree of skill and dexterity is provided in play of the target game.

After the play of the game, i.e., after all of the darts have been thrown in accordance with the rules of the game, the marker members are relatively easily removed from the target face and replaced on the dart impact tip stems 26 for reuse.

In accordance with another embodiment of the present invention it is contemplated that the sheet 18 may be formed of metal and that the markers 28 may be provided with a magnetized surface. Thus, the marker will become magnetically attached to the metal sheet and remain there as the dart body is propelled away from the dart board after impact thereon.

Substantially the same objectives and action obtained by the previously described dart 16 is obtained by the embodiment of the dart identified in FIG. 1 by the reference numeral 16'. This dart construction consists of a dart body 50 which is formed of molded plastic construction to which a marker 52 is removably connected. The marker 52 has a Velcro sheet 36 secured to its front face so that it can be secured to the face 14 of the target 12, in the manner of the marker 28 previously described.

In this embodiment of the invention however the marker 52 itself is formed of a resilient material so as to compress and expand upon impact of the dart against the target, thereby to absorb the momentum of the impact and to propel the dart body 50 away from the dart board. As seen most clearly in FIGS. 5–7, the marker 52 is a one piece element having three distinct sections. That is, the marker includes a main body portion 54 of generally cylindrical configuration and a second intermediate body portion 56 also of generally cylindrical shape. Finally, the marker includes an integral stem 58 extending outwardly and axially of the central section or shoulder 56. This stem 58 has a smaller maximum cross-sectional dimension than the diameter of the central section 56 thereby to define a substantially annular surface 60 around the stem 58.

Stem 58 is received within an opening or recess 62 in the end portion 60 of dart 50. The stem frictionally engages the interior walls of the recess and may be cylindrical or polygonal in shape. At present, the polygonal shape is preferred since the edges of the polygon only will engage the interior surfaces of the recess 62 thereby to reduce the frictional engagement therebetween. However the stem and internal diameter of the recess 62 are dimesioned such that a frictional engagement therebetween is provided which is sufficient to keep the marker engaged with the tip of the dart during the flight of the dart. In addition the stem 58 is dimensioned with respect to the recess 62 so that the outer peripheral edge 64 of the dart tip 60 (i.e., the edge which surrounds the recess 62) engages the surface 60 when the marker is secured in the dart. In this manner, when the marker impacts against the target face 14 the momentum of the dart body 50 will be absorbed in the central resilient portion 56 of the marker 52 thereby allowing the Velcro surfaces on the marker and target board to become engaged. In addition, when the momentum or movement of the dart body ceases, the central portion 56 of the marker expands and thus applies an impulse force to the dart body which propels the dart body away from the marker, thereby releasing the stem 58 from within the recess 62, as seen in FIG. 7.

It will be appreciated that the marker 52 can be formed from any of a number of different types of flexible and resilient materials suitable for the purpose intended herein, however it is contemplated that materials such as elastomeric plastics, polyurethane, and rubber would be satisfactory.

Accordingly, it will be seen that a relatively simply constructed and inexpensive dart board game is provided which has numerous advantages over previously proposed structures. The game is substantially safer than conventional metal tipped dart games, while the cooperating engagement means, i.e., the Velcro strips on the target board and marker elements, assure a positive adhesion of the marker to the target board. In addition, the resilient and releasable impact tip member of the dart body causes the dart to be propelled away from the dart board after an impact to add an additional feature to the play of the game.

Although an illustrative embodiment of the invention has been described herein with reference to the accompanying drawings, it is to be understood that various changes and modifications can be effected therein by those skilled in the art, without departing from the scope and spirit of this invention.

What is claimed is:

1. A dart board game comprising, in combination, a target board having a target face and a dart including a flexible and resilient tip and a marker removably engaged with said tip, said marker and target board including cooperating means for retaining the marker on the target face upon impact of the dart tip with the target face, said flexible and resilient tip being compressed upon such an impact to propel the dart away from the target face; said resilient tip and marker including cooperating means for normally holding the marker in the tip and for releasing the marker in response to propulsion of the dart away from the target face after an impact whereby the marker is disengaged from said tip and remains on the target face while the dart moves away from the target face; said cooperating means on said marker and resilient tip comprising a centrally located outwardly directed stem on said resilient tip and receptacle means on said marker for frictionally and releasably engaging said stem.

2. The dart board game as defined in claim 1 wherein said resilient tip comprises an elastic hollow shell mounted on one end of the dart.

3. The dart board game as defined in claim 2 wherein said shell is generally semi-spherical in shape.

4. The dart board game as defined in claim 2 wherein said dart is in the form of a shuttlecock.

5. The dart board game as defined in claim 2 wherein said cooperating means on said marker and target board comprises a textile covering said marker and target face having outwardly extending hooks formed thereon and a covering on the other side of said marker and target face having outwardly extending relatively stiff hooks thereon adapted to be retained in said loops upon impact of the marker with the target face.

6. The dart board game as defined in claim 2 wherein said cooperating means comprises a magnetized surface on said marker and a metal surface on said target board.

7. A dart board game comprising, in combination, a target board having a target face including a plurality of upstanding loop-like elements, and a dart including a resilient impact tip, a marker, and cooperating means on said tip and marker for releasably engaging the marker with said tip, said marker having an impact face including a multiplicity of stiff hook-like elements thereon which are adapted to be retained in said loop-like elements upn impact with the target face, whereby said resilient tip is initially compressed upon impact of the dart tip marker with the target face, absorbing the momentum of the dart at impact, to allow the hook-like elements to engage and become interlocked with said loop-like elements and retain the marker on the target face, thereby to provide an indication of the area of the target struck by the dart, while the return of the resilient tip after impact from its compressed and deformed condition to its normal condition propels the dart away from the target face and the engaged marker; said cooperating means on said tip and marker releasing the engagement therebetween in response to propulsion of said dart away from the target face whereby the marker is disengaged from said tip and remains on the target face while the dart is propelled away from the target face; said cooperating means including a centrally located outwardly directed stem formed on said impact tip and receptacle means on said marker for frictionally and releasably engaging said stem, said stem and receptacle means being respectively dimensioned such that the frictional adhesion therebetween is less than the adhesion between the marker and target face after an impact, whereby flexing of said tip after compression on impact with the target face propels the dart away from the marker and target face and causes said stem and receptacle means to disengage while the marker remains fixed on the target face.

8. The dart board game as defined in claim 7 wherein said resilient tip comprises an elastic hollow shell mounted on one end of the dart.

9. The dart board game as defined in claim 8 wherein said dart is in the form of a shuttlecock.

10. A dart board game comprising, in combination, a target board having a target face, and a dart including a dart body, a tip, and a marker removably engaged with said tip, said marker being formed of a flexible and resilient material, said marker and target board including cooperating means for retaining the marker on the target face upon an impact of the dart marker with the target face, said flexible resilient material of the marker being compressed upon such an impact by the momentum of the dart body, thereby to propel the dart body away from the target face; said tip and marker including cooperating means for normally holding the marker on the tip and for releasing the marker in response to propulsion of the dart away from the target face after an impact whereby the marker is disengaged from the dart body and remains on the target face while the dart moves away from the target face; said cooperating means comprising a hollow opening formed in one end of said dart body and an elongated stem extending from said marker and received in said opening; said marker including a shoulder formed thereon adjacent said elongated stem, said shoulder being located to engage a portion of the dart body when the marker is engaged therewith whereby said shoulder is compressed upon impact of the marker with the target board thus to propel the dart body away from the target face.

11. The dart board game as defined in claim 10 wherein said elongated stem extends from said marker centrally of said shoulder and received in said opening.

12. The dart board game as defined in claim 11 wherein said stem is polygonal in cross-section to minimize frictional engagement between said stem and said dart body.

13. The dart board game as defined in claim 12 wherein said cooperating means comprises a textile covering on said marker and target face having outwardly extending hooks formed thereon and a covering on the other side of said marker and target face having outwardly extending relatively stiff hooks thereon adapted to be retained in said loops upon impact of the marker with the target face.

* * * * *